US010101067B2

(12) United States Patent
Lundberg et al.

(10) Patent No.: US 10,101,067 B2
(45) Date of Patent: Oct. 16, 2018

(54) HEAT EXCHANGER FOR A REFRIGERANT SERVICE SYSTEM

(71) Applicants: Bosch Automotive Service Solutions LLC, Warren, MI (US); Robert Bosch GmbH, Stuttgart (DE)

(72) Inventors: Dylan M. Lundberg, Lonsdale, MN (US); Mark W. McMasters, Owatonna, MN (US)

(73) Assignees: Bosch Automotive Service Solutions LLC, Warren, MI (US); Robert Bosch GmbH, Stuttgart (DE)

( * ) Notice: Subject to any disclaimer, the term of this patent is extended or adjusted under 35 U.S.C. 154(b) by 484 days.

(21) Appl. No.: 14/542,733

(22) Filed: Nov. 17, 2014

(65) Prior Publication Data

US 2015/0153082 A1 Jun. 4, 2015

Related U.S. Application Data

(60) Provisional application No. 61/911,643, filed on Dec. 4, 2013.

(51) Int. Cl.
*F25B 47/00* (2006.01)
*F25B 43/02* (2006.01)
(Continued)

(52) U.S. Cl.
CPC ..... *F25B 43/02* (2013.01); *F25B 43/006* (2013.01); *F25B 45/00* (2013.01);
(Continued)

(58) Field of Classification Search
CPC ..... F25B 43/02; F25B 43/006; F25B 45/00; F25B 2345/003; F25B 2345/004; F25B 2345/005; F25B 2400/051; F25B 2500/18
See application file for complete search history.

(56) References Cited

U.S. PATENT DOCUMENTS 4,506,523 A * 3/1985 DiCarlo ..... F04B 39/16 210/167.02
4,516,994 A * 5/1985 Kocher ..... B01D 45/12 210/304

(Continued)

FOREIGN PATENT DOCUMENTS

DE 102009038740 A1 3/2011
WO 9119140 A1 12/1991
WO 2012113538 A1 8/2012

OTHER PUBLICATIONS

European Search Report and Written Opinion corresponding European Patent Application 14195263.0, dated Apr. 7, 2015 (6 pages).

*Primary Examiner* — Elizabeth Martin
(74) *Attorney, Agent, or Firm* — Maginot Moore & Beck LLP

(57) ABSTRACT

A refrigerant service system comprises a compressor having a compressor inlet and a compressor outlet, an inlet conduit, an outlet conduit, and an accumulator including an outer housing shell and an inner housing shell disposed within the outer housing shell. A first chamber is defined in the accumulator between the inner housing shell and the outer housing shell, the first chamber being configured to receive refrigerant from the inlet conduit and discharge the refrigerant to the compressor inlet. A second chamber is defined in the accumulator within the inner housing shell, the second chamber being configured to receive the refrigerant from the compressor outlet and discharge the refrigerant to the outlet conduit. Heat is transferred from the refrigerant in the second chamber through the inner shell to the refrigerant in the first chamber.

13 Claims, 6 Drawing Sheets

(51) Int. Cl.
*F25B 45/00* (2006.01)
*F25B 43/00* (2006.01)

(52) U.S. Cl.
CPC ... *F25B 2345/003* (2013.01); *F25B 2345/004* (2013.01); *F25B 2345/005* (2013.01); *F25B 2400/051* (2013.01); *F25B 2500/18* (2013.01)

(56) References Cited

U.S. PATENT DOCUMENTS

| | | | | |
|---|---|---|---|---|
| 5,377,501 | A * | 1/1995 | Muston | F25B 40/00 55/421 |
| 5,433,081 | A * | 7/1995 | Major | F25B 45/00 62/292 |
| 6,494,057 | B1 * | 12/2002 | Schuster | F25B 43/006 62/474 |
| 6,530,230 | B2 * | 3/2003 | Makizono | F25B 40/00 62/217 |
| 6,681,597 | B1 * | 1/2004 | Yin | F25B 40/00 62/503 |
| 2009/0107164 | A1 * | 4/2009 | Colnaghi | F25B 45/00 62/292 |
| 2013/0008192 | A1 | 1/2013 | McMasters et al. | |
| 2014/0033742 | A1 * | 2/2014 | Esch | B60H 1/00585 62/77 |
| 2014/0182312 | A1 | 7/2014 | Lundberg et al. | |

* cited by examiner

HEAT EXCHANGER FOR A REFRIGERANT SERVICE SYSTEM

CLAIM OF PRIORITY

This application claims the benefit of priority to U.S. provisional application No. 61/911,643, entitled "Heat Exchanger for a Refrigerant Service system," which was filed on Dec. 4, 2013, the disclosure of which is incorporated herein by reference in its entirety.

TECHNICAL FIELD

This disclosure relates generally to refrigeration systems, and more particularly to refrigerant recovery systems for refrigeration systems.

BACKGROUND

Air conditioning systems are currently commonplace in homes, office buildings and a variety of vehicles including, for example, automobiles. Over time, the refrigerant included in these systems gets depleted and/or contaminated. As such, in order to maintain the overall efficiency and efficacy of an air conditioning system, the refrigerant included therein may be periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include hoses coupled to the refrigeration circuit to be serviced. A vacuum pump and compressor operate to recover refrigerant from the vehicle's air conditioning unit, flush the refrigerant, and subsequently recharge the system from a supply of either recovered refrigerant and/or new refrigerant from a refrigerant tank.

Refrigerant vapor entering the ACS unit first passes through a system oil separator or accumulator to remove oil entrained in the refrigerant from the air conditioning system. Next, the refrigerant passes through a filter and dryer unit to remove contaminants and moisture from the recovered refrigerant and then the refrigerant is pressurized by a compressor.

Refrigerant vapor is very hot as it exits the compressor during an AC recovery cycle. In a typical flow path, this hot refrigerant enters a compressor oil separator, which separates any compressor oil entrained in the refrigerant from the compressor pass-through from the refrigerant vapor. The compressor oil is then returned to the compressor, and the refrigerant vapor continues along the flow path into a heat exchanger, which assists within the system oil separator or accumulator found earlier in the path. The compressor oil separator and system heat exchanger are two completely different entities within the standard flow path.

In current ACS units, the accumulator, finned-tube heat exchanger, filter and dryer unit, and compressor oil separator are all mounted to the same aluminum manifold block. This enables efficient routing between the components within the block. This also allows for easy access to specific areas within the flow path for valves and sensory components, such as pressure transducers or high pressure switches.

In present systems, a relatively large manifold block footprint is necessary to physically accommodate the components, particularly the larger components such as the heat exchanger, filter and dryer unit, and compressor oil separator. Additionally, heat is lost by the refrigerant in the compressor oil separator and flow tubes between the compressor, compressor oil separator, and heat exchanger, limiting the amount of heat transferred to the accumulator and reducing the overall efficiency of the recovery unit. What is needed, therefore, is an improved heat exchanger for a refrigerant recovery unit.

SUMMARY

A refrigerant service system according to the disclosure comprises a compressor having a compressor inlet and a compressor outlet, an inlet conduit, an outlet conduit, and an accumulator including an outer housing shell and an inner housing shell disposed within the outer housing shell. A first chamber is defined in the accumulator between the inner housing shell and the outer housing shell, the first chamber being configured to receive refrigerant from the inlet conduit and discharge the refrigerant to the compressor inlet. A second chamber is defined in the accumulator separate from the first chamber within the inner housing shell, the second chamber being configured to receive the refrigerant from the compressor outlet and discharge the refrigerant to the outlet conduit. The first and second chambers are arranged such that heat is transferred from the refrigerant in the second chamber through the inner shell to the refrigerant in the first chamber. The refrigerant service system according to the disclosure has the advantage that the accumulator includes two chambers, such that compressor oil separation and system oil separation are performed in the same accumulator, requiring less installation space. Furthermore, heat from the refrigerant in the second chamber is used to heat the refrigerant in the first chamber, reducing energy losses in the refrigeration service system and power consumption of the system.

In another embodiment, the refrigerant service system further includes a compressor oil return line connecting the compressor oil outlet passage to an oil return port of the compressor and configured to return compressor oil removed from the refrigerant in the second chamber to the compressor. Compressor oil collected in the second chamber can advantageously be returned to the compressor.

In yet another embodiment, a compressor oil outlet passage is defined in the inner shell having a first end that opens to the second chamber and a second end that connects to the compressor oil return line. Compressor oil collected in the second chamber can advantageously be returned through the compressor oil outlet passage defined in the inner shell through the compressor oil return line to the compressor.

In a further embodiment according to the disclosure, the accumulator includes a compressor oil suction tube having a first end connected to the compressor oil return line and a second end positioned at a bottom region of the second chamber. Compressor oil collected in the second chamber can advantageously be returned through the compressor oil suction tube in the second chamber and the compressor oil return line to the compressor.

In another embodiment, a bottom end of the outer shell is tapered to a lowest region, and the lowest region includes a system oil drain. System oil collected in the first chamber can therefore be drained from the lowest region of the first chamber.

In one embodiment, the accumulator further comprises a refrigerant inlet port connected to the inlet conduit and an input injection tube having a first end connected to the refrigerant inlet port and a second end configured to discharge refrigerant against an outer surface of the inner shell.

Refrigerant can advantageously be discharged against the outer surface of the heated inner shell, facilitating vaporization of the refrigerant.

In another embodiment an outer surface of the inner shell includes a plurality of ribs along an axial length of the outer surface. The ribs increase the surface area of the outer surface and facilitate better heat transfer.

In a further embodiment, an outer surface of the inner shell is cylindrical and smooth to enable liquid oil on the outer surface to flow downwardly and drip from the inner shell.

In yet a further embodiment, the refrigerant service system includes a manifold block to which the inner and outer shells are mounted. The manifold block defining the inlet conduit, a first conduit through which the refrigerant flows between the first chamber and the compressor inlet, a second conduit through which the refrigerant flows between the compressor outlet and the second chamber, and the outlet conduit. The manifold block is easily manufactured to tight tolerances and enables precise routing of the conduits in the refrigerant service system. The manifold block further serves as a firm support for the inner and outer shells of the accumulator.

The accumulator may include a coalescing filter located at an inlet of the second chamber and configured to coalesce compressor oil condensed from the refrigerant in the second chamber. The coalescing filter improves separation of the compressor oil from the refrigerant in the second chamber.

In another embodiment, the refrigerant service system further comprises a filter and dryer unit positioned between the first chamber and the compressor inlet and configured to receive refrigerant from the first chamber and discharge the refrigerant to the compressor inlet. The filter and dryer unit advantageously removes moisture and particles from the refrigerant before it arrives at the compressor.

In one embodiment, the refrigerant service system includes a refrigerant storage vessel configured to receive the refrigerant from the outlet conduit. The refrigerant storage vessel enables the recovered refrigerant to be stored for subsequent reuse.

In yet another embodiment according to the disclosure, a method of recovering refrigerant from an air conditioning system comprises moving refrigerant from a first chamber defined between an outer shell and an inner shell of a heat exchanger to a compressor, and heating and compressing the refrigerant with the compressor after the refrigerant leaves the first chamber of the heat exchanger. The method further includes moving the heated and compressed refrigerant from the compressor to the second chamber and transferring heat from the refrigerant in the second chamber through the outer shell to the refrigerant in the first chamber to vaporize the refrigerant in the first chamber and separate system oil from the refrigerant in the first chamber and to condense compressor oil from the refrigerant in the second chamber. The method facilitates compressor oil separation and system oil separation in the same accumulator, enabling a more compact unit to perform the method. Furthermore, heat from the refrigerant in the second chamber is used to heat the refrigerant in the first chamber, reducing energy losses and power consumption.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
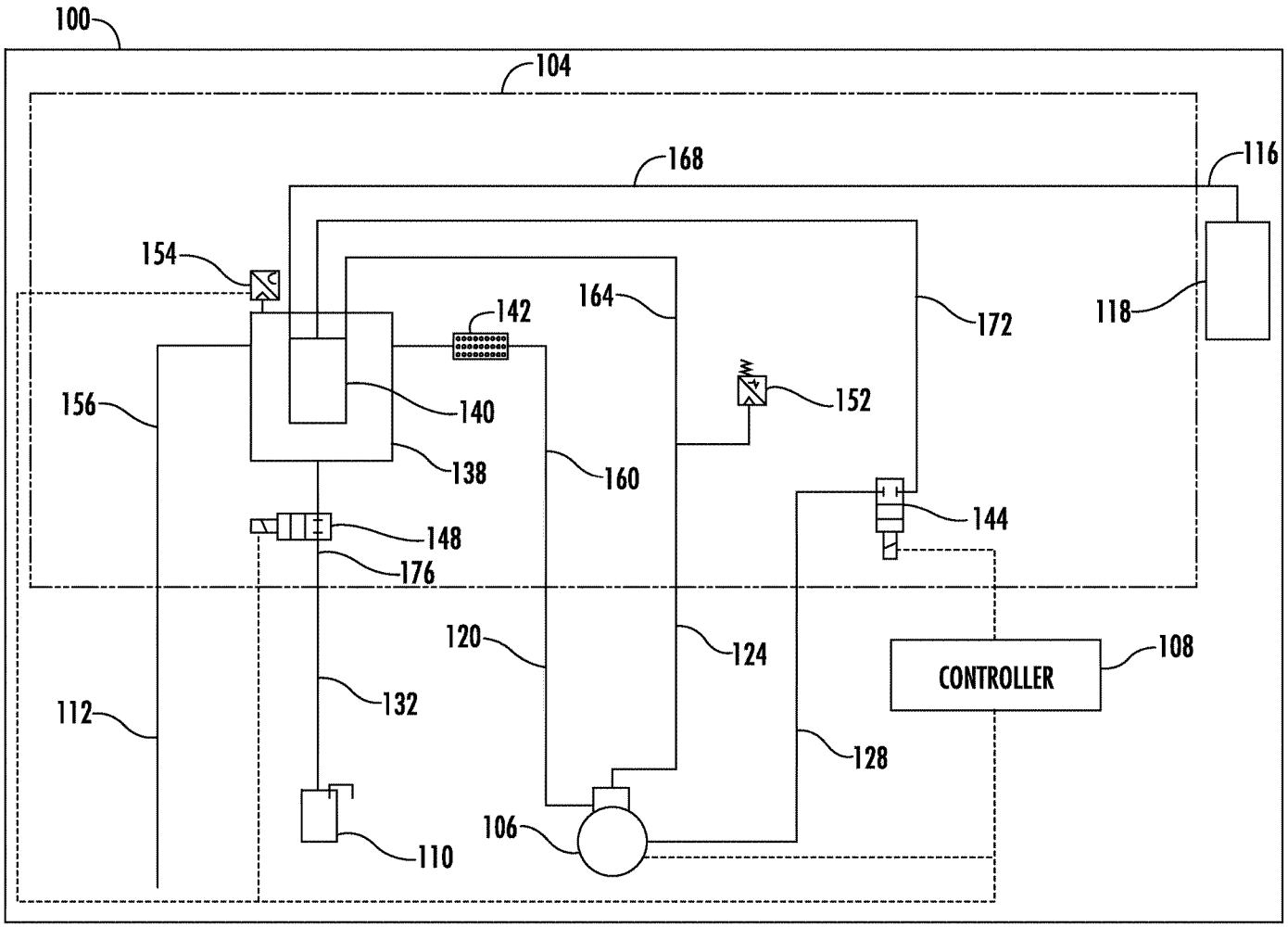
FIG. 1 is a schematic diagram of a refrigerant service system.

FIG. 1 is a schematic diagram of a refrigerant service cart 100 for servicing an air conditioning system. The refrigerant service system 100 includes a manifold 104, a compressor 106, a controller 108, and an oil drain receptacle 110. The system 100 also includes a refrigerant input hose 112 configured to receive refrigerant, typically from a vehicle being serviced or an external storage vessel (not shown), and a refrigerant discharge hose 116 connecting the manifold 104 to a refrigerant storage tank 118, also referred to as an internal storage vessel or ISV. The system 100 further includes a compressor suction hose 120, a compressor discharge tube 124, and a compressor oil return hose 128 connecting the manifold 104 to the compressor 106. An oil drain tube 132 connects the manifold 104 to the system oil drain receptacle 110. In some embodiments, the refrigerant service system 100 is contained entirely within a portable cart (not shown) to enable simple transportation and connection of the system 100 to an air conditioning system.

The manifold 104 includes an accumulator 138, in which a compressor oil separator 140 is mounted, a filter and dryer unit 142, an oil return solenoid valve 144, an oil drain solenoid valve 148, a high pressure switch 152, and a transducer 154. The manifold 104 further includes a variety of connecting conduits bored within the block 134 to connect the various components of the manifold 104 to the hoses and tubes discussed above. A refrigerant input conduit 156 connects the refrigerant input hose 112 to the accumulator 138. A compressor suction conduit 160 carries refrigerant from the accumulator 138 to the filter and dryer 142 and to the compressor suction hose 120, while a compressor discharge conduit 164 carries refrigerant from the compressor discharge tube 124 to the compressor oil separator 140. A refrigerant discharge conduit 168 fluidly connects the compressor oil separator 140 to the refrigerant discharge tube 116. A compressor oil return conduit 172 carries compressor oil from the compressor oil separator 140 to the compressor oil return hose 128, and a system oil drain 176 connects the system oil drain solenoid valve 148 to the system oil drain tube 132.

Figure 3:
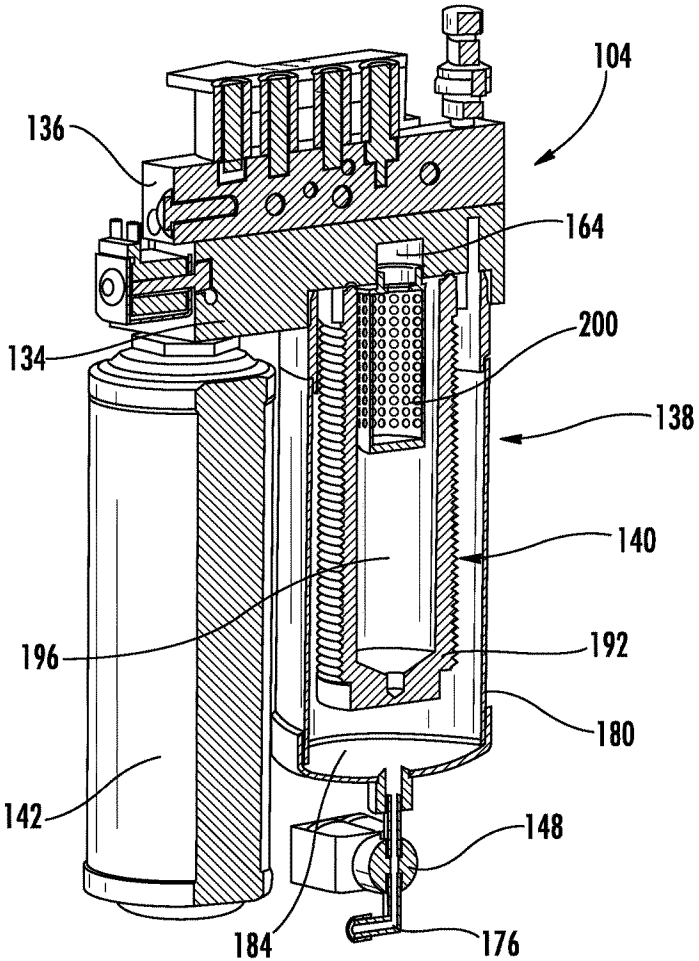
FIG. 3 is a cutaway side perspective view of the manifold of FIG. 2 showing the combined heat exchanger and compressor oil separator within the accumulator.
Figure 2:
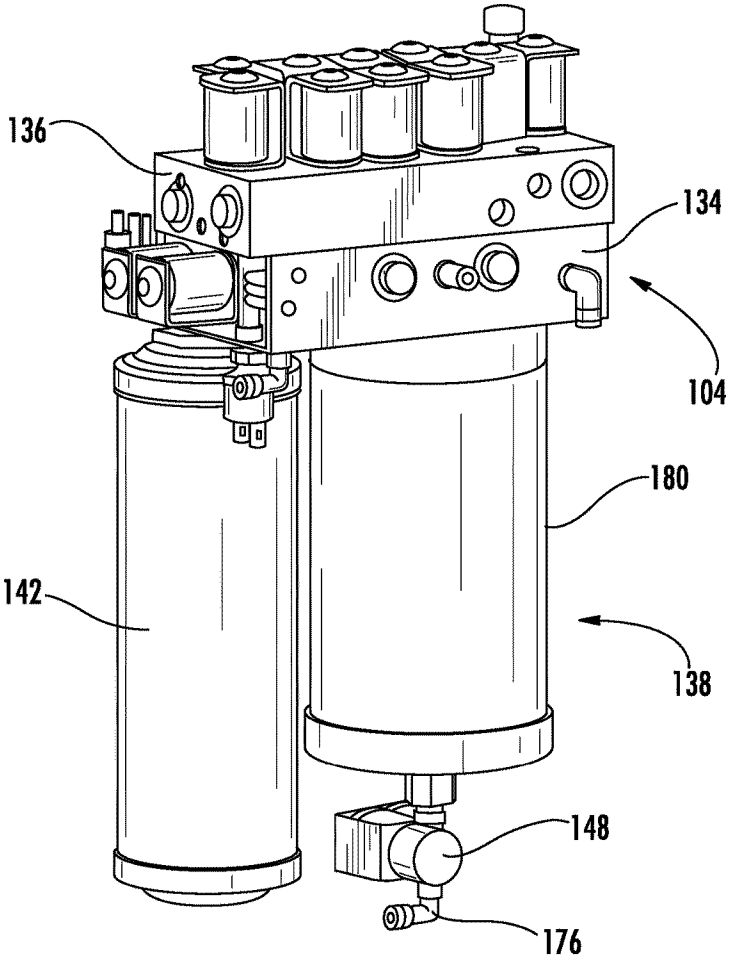
FIG. 2 is a side perspective view of the manifold of the refrigerant service system of FIG. 1.

Referring to FIGS. 2 and 3, the manifold 104 includes a lower manifold block 134 and an upper manifold block 136. The accumulator 138 and the filter and dryer unit 142 are mounted to an exterior of the lower manifold block 134 within an accumulator port 178 (FIG. 5) and a filter and dryer port 179 (FIG. 5), respectively. The system oil drain solenoid 148 is mounted to the bottom of the accumulator 138.

Figure 4:
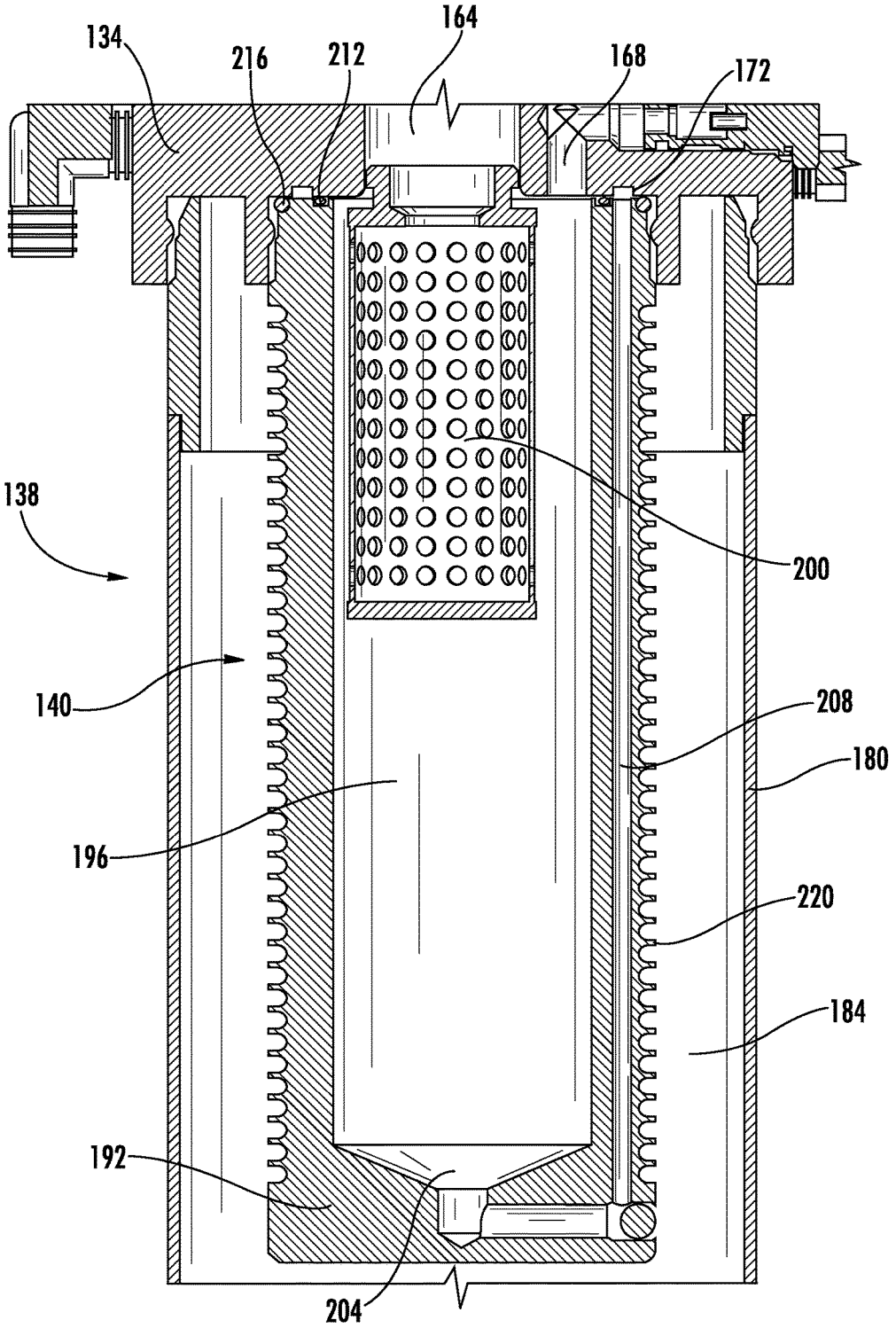
FIG. 4 is a cross-sectional view of the accumulator of FIG. 3 having the combination heat exchanger and compressor oil separator located within the accumulator.

FIG. 4 is a cross-sectional view of the accumulator 138 and the compressor oil separator 140. The accumulator 138 includes an accumulator shell 180, which defines an accumulator chamber 184 between the inner wall of the shell 180 and the exterior of the compressor oil separator 140.

Figure 6:
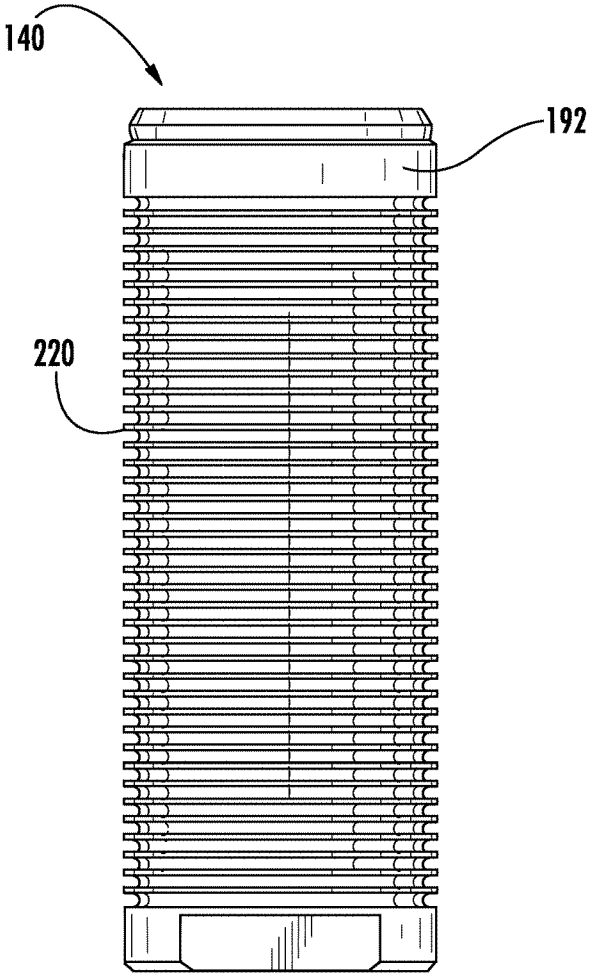
FIG. 6 is a side view of the combined heat exchanger and compressor oil separator of FIG. 4.
Figure 5:
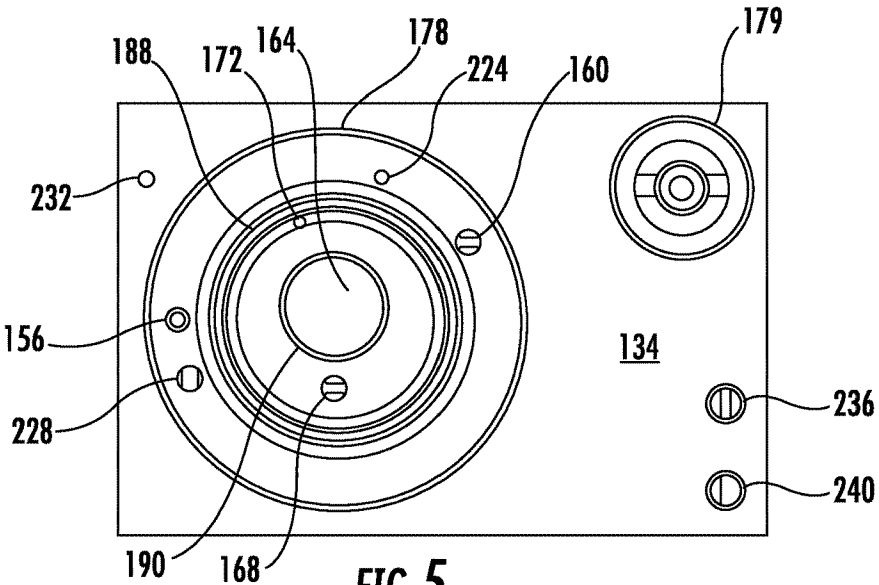
FIG. 5 is a bottom view of the manifold block of the refrigerant service system of FIG. 4.

With reference to FIGS. 4 and 5, the compressor oil separator 140 is mounted to the lower manifold block 134 within the accumulator shell 180 at a compressor oil separator connection 188 in the lower manifold block 134. The compressor oil separator 140 includes a compressor oil separator body 192 defining a compressor oil separation chamber 196 therein, and a coalescing filter 200 within the compressor oil separator 140 and mounted to a coalescing filter port 190 of the lower manifold block 134. At a lower portion of the compressor oil separation chamber 196, a compressor oil collection region 204 funnels fluid into a compressor oil outlet passage 208 defined in the oil separator body 192, and the compressor oil outlet passage 208 connects the compressor oil separation chamber 196 to the compressor oil return conduit 172. Inner O-ring 212 and outer O-ring 216 seal the compressor oil separator body 192 against the lower manifold block 134 to seal the compressor oil separation chamber 140 and the accumulator chamber 184, respectively, from the compressor oil return conduit 172. In the illustrated embodiment, the outer surface of the compressor oil separator body 192 has a plurality of fins 220 (shown in FIGS. 4 and 6) to increase the outer surface area of the compressor oil separator body 192, though in other embodiments the outer surface of the compressor oil separator body has different surface features or is smooth.

As is illustrated in FIG. 5, the lower manifold block 134 includes a deep recovery inlet 224 and a tank fill inlet 228 inside an area bounded by the accumulator mount 178. Outside of the area bounded by the accumulator mount 178, the bottom surface of the lower manifold block 134 includes a datum through hole 232 and two pressure transducer ports 236, 240.

The controller 108 is operatively connected to the compressor 106, the compressor oil return solenoid valve 144, the system oil drain solenoid valve 148, and the pressure transducer 154. The controller 108 is configured to selectively activate the solenoid valves 144, 148 and the compressor 106. The pressure transducer 154 is configured to transmit a signal indicative of the pressure within the accumulator chamber 184 to the controller 108.

Operation and control of the various components and functions of the refrigerant recharge system 100 are performed with the aid of the controller 108. The controller 108 is implemented with general or specialized programmable processors that execute programmed instructions. The instructions and data required to perform the programmed functions are stored in a memory unit associated with the controller 108. The processors, memory, and interface circuitry configure the controller 108 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In use, an operator connects the refrigerant service system 100 to service ports of an air conditioning system, for example a vehicle air conditioning system, to initiate a refrigerant recovery operation. The controller 108 activates a series of valves (not shown) between the refrigerant input hose 112 and the air conditioning system to open the path from the air conditioning system to the refrigerant input hose to remove refrigerant from the air conditioning system. The refrigerant flows through the refrigerant input hose 112 and into the refrigerant input conduit 156 in the manifold 104. The refrigerant then enters the accumulator chamber 184, where the heat from the compressor oil separator 140 vaporizes the refrigerant. A small amount of system oil is typically entrained in the refrigerant during normal use in the air conditioning system. The system oil has a higher boiling point than the refrigerant, and therefore remains in a liquid phase and falls to the bottom of the accumulator 138 under the force of gravity as the refrigerant is vaporized. The system oil accumulates at the bottom of the accumulator chamber 184 until the system oil drain solenoid valve 148 is opened and the system oil flows through the oil drain 176 and the system oil drain tube 132 into the system oil drain receptacle 110.

The controller 108 activates the compressor 106 to generate a negative pressure in the compressor suction hose 120 and compressor suction conduit 160, pulling the vaporized refrigerant in the accumulator chamber 184 through the filter and dryer unit 142. The filter and dryer unit 142 removes moisture and other contaminants present in the refrigerant. The refrigerant continues through the compressor suction conduit 160 and the compressor suction hose 120 into the compressor 106. The compressor 106 pressurizes the refrigerant and forces the refrigerant through the compressor discharge tube 124 back into the compressor discharge conduit 164 in the manifold 104. The high pressure switch 152 is located in the compressor discharge conduit 164 and is configured to deactivate the compressor if the pressure downstream of the compressor 106 exceeds a threshold value to prevent excess pressure in the components downstream of the compressor 106. During the pass through the compressor 106, the temperature of the refrigerant increases substantially, such that the refrigerant in the compressor discharge conduit 164 is hotter than the refrigerant coming into the system.

The heated and pressurized refrigerant then enters the coalescing filter 200 in the compressor oil separator 140. The hot refrigerant in the compressor oil separator 140 transfers heat to the compressor oil separator body 192, heating the compressor oil separator body 192. The compressor oil separator body 192 transfers heat to the refrigerant and oil in the accumulator chamber 184 to assist in vaporizing the refrigerant entering the accumulator 138. The compressor oil separator 140 therefore also serves as a heat exchanger within the accumulator 138.

During the pass through the compressor 106, a small quantity of compressor oil may be entrained in the refrigerant. As the refrigerant enters the compressor oil separator 140, the heat removed from the refrigerant vapor causes the compressor oil, which has a lower condensation temperature than the refrigerant, to condense in the compressor oil separation chamber 196. The fine liquid oil particles coalesce on the coalescing filter 200 and, once large enough, drip downwardly to the compressor oil collection region 204. The refrigerant vapor, now free of compressor oil, passes into the refrigerant discharge conduit 168 and then into the refrigerant discharge hose 116 to be stored in the refrigerant storage tank 118 or otherwise reused.

The system 100 is also configured to periodically initiate a system oil drain process when a recovery operation is in progress. During the system oil drain process, the controller 108 deactivates the compressor 106 and activates the solenoid valve 144 to open, linking the accumulator chamber 184 to the compressor 106 through the compressor oil return conduit 172. The compressor oil return hose 128 is connected to the compressor suction hose 120 through the compressor 106, and therefore opening the solenoid valve 144 fluidly connects the accumulator chamber 184 to the compressor oil separator chamber 196 through the compressor suction conduit 160, the compressor suction hose 120, the compressor 106, the compressor oil return hose 128, and the compressor oil return conduit 172. Refrigerant remaining in the compressor oil separator chamber 196 and compressor discharge conduit 164 is at a higher pressure than the accumulator chamber 184 due to being previously passed through the compressor 106. As a result, the refrigerant travels from the compressor oil separator chamber 196 and compressor discharge conduit 164 into the accumulator chamber 184, increasing the pressure in the accumulator chamber 184. The pressure transducer 152 senses the pressure in the accumulator chamber 184, and once the pressure in the accumulator chamber 184 reaches a predetermined threshold, the controller 108 operates the compressor oil return solenoid valve 144 to close and the system oil drain solenoid valve 148 to open. In some embodiments, the solenoid valve 144 remains open while the oil drain solenoid valve 148 is opened.

The increased pressure in the accumulator chamber 184 forces system oil in the accumulator chamber 184 through the system oil drain 176 and oil drain tube 132 into the system oil drain receptacle 110. The controller 108 is configured to monitor the pressure signal generated by the transducer 152 and close the system oil drain solenoid valve 148 upon detection of spike in pressure in the accumulator chamber 184 indicating that the system oil has been removed from the chamber 184. In some embodiments, the system oil is removed from the accumulator chamber 184 by gravity, without additional pressure, once the system oil drain solenoid valve 148 is opened.

During the refrigerant recovery operation, the system 100 periodically initiates a compressor oil return process to return compressor oil collected in the compressor oil separation chamber 196 to the compressor 106. During the refrigerant recovery operation, the compressor 106 generates a constant suction in the compressor oil return conduit 172. To recover the compressor oil, the controller 108 operates the compressor oil return solenoid valve 144 to open, enabling flow through the compressor oil return conduit 172. The suction in the compressor oil return conduit 172 combined with the overpressure in the compressor oil separator chamber 184 urges the compressor oil collected in the compressor oil collection region 204 through the compressor oil outlet passage 208. The compressor oil then flows through the compressor oil return conduit 172 and the compressor oil return hose 128 back into the compressor 106.

Figure 7:
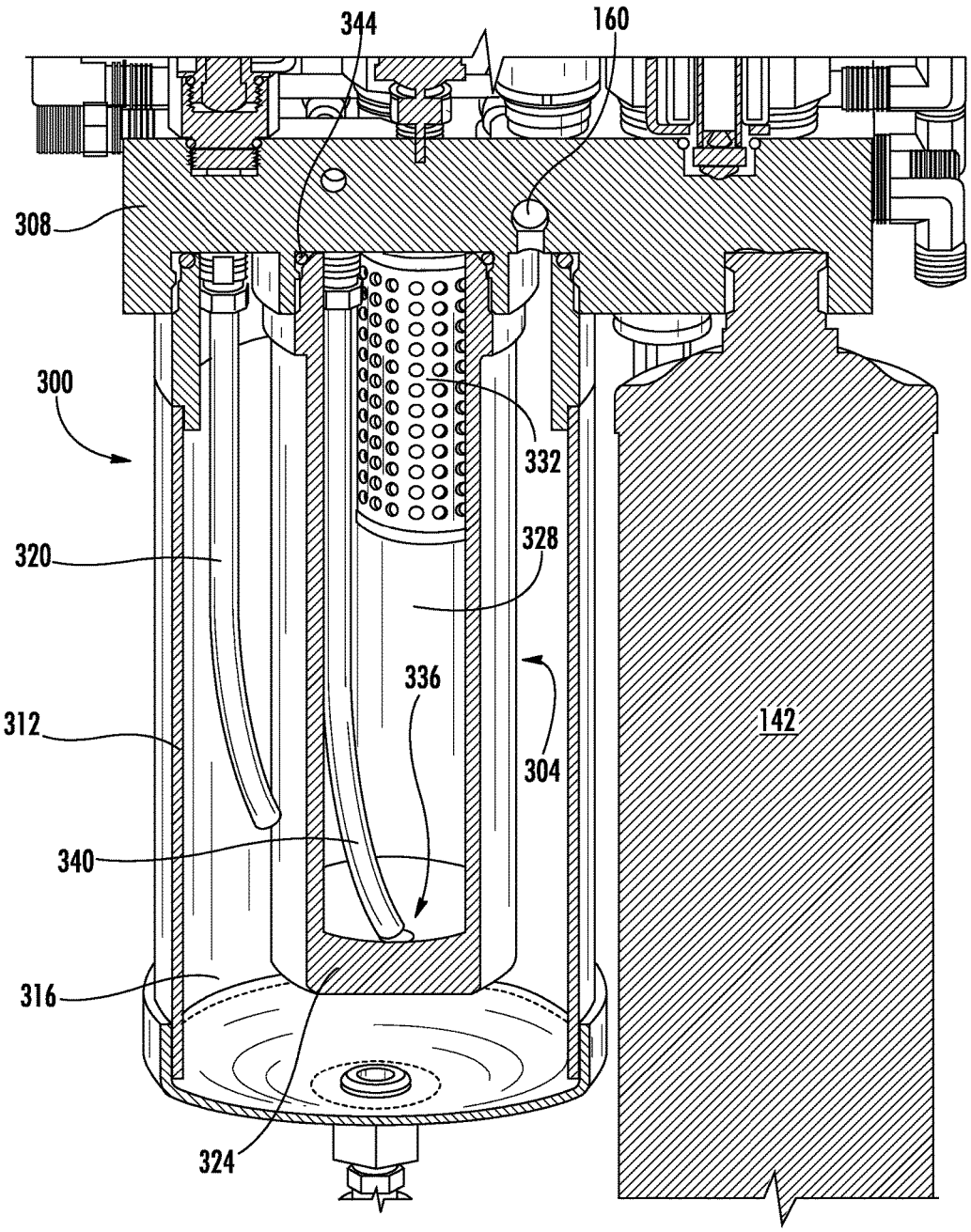
FIG. 7 is a cutaway view of a manifold of another embodiment of a refrigerant service system having a combination heat exchanger and compressor oil separator located within the accumulator.
Figure 8:
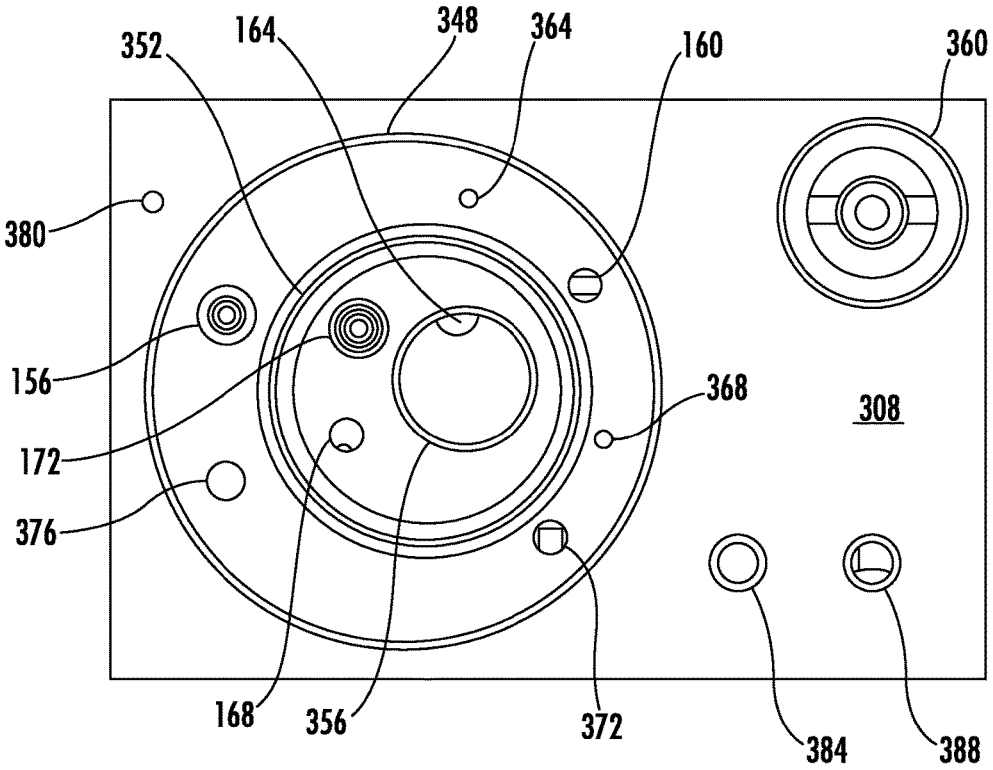
FIG. 8 is a bottom view of the manifold block of the refrigerant service system of FIG. 7.

FIGS. 7 and 8 illustrate another embodiment of a combined accumulator 300 and compressor oil separator 304 for use in place of the accumulator 138 in the system 100 of FIG. 1. The accumulator 300 is attached to a lower manifold block 308 at an accumulator mount 348. The lower manifold block 308 of the embodiment of FIGS. 7 and 8 is configured similar to the lower manifold block 134 discussed above, though some of the connections are positioned in different locations. The accumulator 300 includes an accumulator shell 312, which defines an accumulator chamber 316 between the inner wall of the shell 312 and the exterior of the compressor oil separator 304. The accumulator 300 further includes an input injection tube 320 connected to the input conduit 156 and the input hose 112 of the manifold 104 (FIG. 1).

The compressor oil separator 304 is mounted to the lower manifold block 308, within the accumulator shell 312, at a compressor oil separator connection 352. The compressor oil separator 304 includes an oil separator body 324 defining a compressor oil separation chamber 328 therein, and a coalescing filter 332 mounted to the lower manifold block 308 at a coalescing filter port 356. At a lower portion of the compressor oil separation chamber 328, a compressor oil collection region 336 collects the compressor oil in the oil separation chamber 328. A compressor oil suction tube 340 is positioned with an open end in the compressor oil collection region 336, and its other end connected to the compressor oil return conduit 172 of the manifold 104 (FIG. 1). An elastomeric seal, for example an O-ring 344, seals the compressor oil separator body 324 against the lower manifold block 308 to seal the compressor oil separation chamber 328 from the accumulator chamber 316. In the embodiment of FIG. 7, the outer surface of the oil separator body 324 is smooth to facilitate system oil travelling down the outer surface under the force of gravity.

FIG. 8 depicts the bottom side of the lower manifold block 308, illustrating the connection ports in the bottom of the lower manifold block 308. The lower manifold block 308 includes a filter and dryer port 360 for connection of the filter and dryer unit 142. The view of FIG. 8 also illustrates the positions of the input conduit 156, the compressor suction conduit 160, the compressor discharge conduit 164, the refrigerant discharge conduit 168, and the compressor oil return conduit 172. Within an area in which the accumulator 300 is connected, the lower manifold block 308 includes a deep recovery inlet 364, a recycling inlet 368, an identifier recovery inlet 372, and a tank fill inlet 376. The exterior of the bottom surface of the lower manifold block 308 also has a datum through hole 380 and two pressure transducer ports 384, 388.

The operation of the embodiment of FIGS. 7-8 is substantially identical to that of the embodiment discussed above with regard to FIGS. 1-6. After commencing a refrigerant recovery operation, refrigerant from the air conditioning system is passed through the refrigerant input hose 112 and into the refrigerant input conduit 156 in the manifold 104. The refrigerant then enters the accumulator chamber 316 through the input injection tube 320, which directs the incoming refrigerant onto the smooth outer surface of the compressor oil separator body 324. Heat from the compressor oil separator 304 assists in vaporizing the refrigerant, while system oil in the refrigerant remains in a liquid phase and flows down the smooth outer surface of the compressor oil separator body 324 under the force of gravity. The system oil drips off the compressor oil separator 304 and accumulates at the bottom of the accumulator chamber 316 until a system oil drain process is initiated.

The compressor 106 generates a negative pressure in the compressor suction hose 120 and compressor suction conduit 160, pulling the vaporized refrigerant in the accumulator chamber 316 through the filter and dryer unit 142, which removes moisture and other contaminants present in the refrigerant. The refrigerant continues through the compressor suction conduit 160 and the compressor suction hose 120 into the compressor 106, where the refrigerant is pressurized and the temperature of the refrigerant increases. The heated and pressurized refrigerant then travels through the compressor discharge tube 124 back into the compressor discharge conduit 164 in the manifold 104. The high pressure switch 152 is located in the compressor discharge conduit 164 and is configured to automatically deactivate the compressor 106 if the pressure downstream of the compressor 106 exceeds a threshold value to prevent an overcharge condition of the compressor 106.

During the pass through the compressor 106, a small quantity of compressor oil may be entrained in the refrigerant. As the refrigerant enters the compressor oil separator 304, the heat removed from the refrigerant vapor causes the compressor oil, which has a lower condensation temperature than the refrigerant, to condense in the compressor oil separator chamber 328. The fine liquid oil particles coalesce on the coalescing filter 332 and, once large enough, drip downwardly to the compressor oil collection region 336. The refrigerant vapor, now free of compressor oil, passes into the compressor oil separator chamber 328, to the refrigerant discharge conduit 168, and into the refrigerant discharge hose 116 to be stored in the refrigerant storage tank 118 or otherwise reused.

The heated refrigerant in the compressor oil separator chamber 328 transfers heat to the compressor oil separator body 324, which passes heat to the refrigerant injected through the input injection tube 320 onto the outer surface of the compressor oil separator body 324 in the accumulator chamber 316. The compressor oil separator 304 therefore also serves as a heat exchanger within the accumulator 300.

The system 100 is also configured to periodically initiate a system oil drain process when the refrigerant recovery operation is in progress. During the system oil drain process, the controller 108 deactivates the compressor 106 and activates the compressor oil return solenoid valve 144 to open, linking the accumulator chamber 316 to the compressor 106 through the compressor oil return conduit 172. The compressor oil return hose 128 is connected to the compressor suction hose 120 through the compressor 106, and therefore opening the compressor oil return solenoid valve 144 fluidly connects the accumulator chamber 316 to the compressor oil separator chamber 328 through the compressor suction conduit 160, the compressor suction hose 120, the compressor 106, the compressor oil return hose 128, and the compressor oil return conduit 172. Refrigerant remaining in the compressor oil separator chamber 328 and the compressor discharge conduit 164 has a higher pressure than the accumulator chamber 316 due to being previously passed through the compressor 106. As a result, the refrigerant travels from the compressor oil separator chamber 328 and compressor discharge conduit 164 into the accumulator chamber 316, increasing the pressure in the accumulator chamber 316. The pressure transducer 154 senses the pressure in the accumulator chamber 316, and once the pressure in the accumulator chamber 316 reaches a predetermined threshold, the controller 108 operates the compressor oil return solenoid valve 144 to close and the system oil drain solenoid valve 148 to open. In some embodiments, the compressor oil return solenoid valve 144 remains open while the system oil drain solenoid valve 148 is opened.

The increased pressure in the accumulator chamber forces system oil in the accumulator chamber 316 through the oil drain 176 and oil drain tube 132 into the oil drain receptacle 110. The controller 108 continues to monitor the pressure signal generated by the transducer 152, and closes the oil drain solenoid valve 148 upon detection of a spike in pressure in the accumulator chamber 316 indicating that the oil has been removed from the chamber 316. In some embodiments, the accumulator chamber 316 is not pressurized during a system oil recovery operation, and the system oil is recovered by opening the system oil drain solenoid valve 148 and allowing the oil to drain by gravity to the system oil drain receptacle 110.

During the refrigerant recovery operation, the system 100 periodically initiates a compressor oil return process to return compressor oil collected in the compressor oil separation chamber 328 to the compressor 106. During the refrigerant recovery operation, the compressor 106 generates a constant suction in the compressor oil return conduit 172. To recover the compressor oil, the controller 108 operates the compressor oil return solenoid valve 144 to open, enabling flow through the compressor oil return conduit 172. The suction in the compressor oil return conduit 172 combined with the overpressure in the compressor oil separator chamber 324 urges the compressor oil in the collection region 336 into the compressor oil suction tube 340. The compressor oil then flows through the compressor oil return conduit 172 and the compressor oil return hose 128 back into the compressor 106.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. A refrigerant service system comprising:

a compressor having a compressor inlet and a compressor outlet;

an inlet conduit;

an outlet conduit; and an accumulator including an outer housing shell and an inner housing shell disposed within the outer housing shell, wherein a first chamber is defined in the accumulator between the inner housing shell and the outer housing shell, the first chamber being configured to receive refrigerant from the inlet conduit and discharge the refrigerant to the compressor inlet, wherein a second chamber is defined in the accumulator separate from the first chamber within the inner housing shell, the second chamber being configured to receive compressed refrigerant from the compressor outlet and discharge the compressed refrigerant to the outlet conduit, wherein the first and second chambers are arranged such that heat is transferred from the compressed refrigerant in the second chamber through the inner shell to the refrigerant in the first chamber, wherein the second chamber includes a coalescing region and an oil collection region, the second chamber configured such that compressor oil entrained in the compressed refrigerant coalesces in the coalescing region and accumulates in the oil collection region, and wherein the refrigerant service system is configured to move the refrigerant along a refrigerant flow path defined from the inlet conduit, to the first chamber, through the compressor, to the second chamber, and to the outlet conduit.

2. The refrigerant service system of claim 1, further comprising:

a compressor oil return line connecting the second chamber to an oil return port of the compressor and configured to return the compressor oil removed from the compressed refrigerant in the second chamber to the compressor.

3. The refrigerant service system of claim 2, wherein a compressor oil outlet passage is defined in the inner housing shell having a first end that opens to the second chamber and a second end that connects to the compressor oil return line.

4. The refrigerant service system of claim 2, the accumulator further comprising:

a compressor oil suction tube having a first end connected to the compressor oil return line and a second end positioned in the oil collection region at a bottom region of the second chamber.

5. The refrigerant service system of claim 1, wherein a bottom end of the outer housing shell is tapered to a lowest region, and the lowest region includes a system oil drain.

6. The refrigerant service system of claim 1, the accumulator further comprising:

a refrigerant inlet port connected to the inlet conduit; and an input injection tube having a first end connected to the refrigerant inlet port and a second end configured and arranged so as to discharge refrigerant against an outer surface of the inner housing shell.

7. The refrigerant service system of claim 1, wherein an outer surface of the inner housing shell includes a plurality of ribs along an axial length of the outer surface.

8. The refrigerant service system of claim 1, wherein an outer surface of the inner housing shell is cylindrical and smooth.

9. The refrigerant service system of claim 1, further comprising:

a manifold block to which the inner and outer housing shells are mounted, the manifold block defining the inlet conduit, a first conduit through which the refrigerant flows between the first chamber and the compressor inlet, a second conduit through which the compressed refrigerant flows between the compressor outlet and the second chamber, and the outlet conduit.

10. The refrigerant service system of claim 9, the accumulator further comprising:

a coalescing filter located in the coalescing region of the second chamber at an inlet of the second chamber and configured to coalesce the compressor oil condensed from the compressed refrigerant in the second chamber.

11. The refrigerant service system of claim 1, further comprising:

a filter and dryer unit positioned between the first chamber and the compressor inlet and configured to receive refrigerant from the first chamber and discharge the refrigerant to the compressor inlet.

12. The refrigerant service system of claim 1, further comprising:

a refrigerant storage vessel configured to receive the refrigerant from the outlet conduit.

13. The refrigerant service system of claim 1, wherein the first chamber does not include a heat exchanger coil.

* * * * *